US006190007B1

(12) United States Patent
Taylor et al.

(10) Patent No.: US 6,190,007 B1
(45) Date of Patent: Feb. 20, 2001

(54) APPARATUS FOR DELIVERING FLUID TO AN INK JET PRINTHEAD MOUNTED ON A MOVEABLE PRINTER CARRIAGE

(75) Inventors: Christopher C. Taylor; Xavier Girones; Sergio de Santiago; Antoni Murcia Serra, all of Barcelona (ES)

(73) Assignee: Hewlett-Packard Company Intellectual Property Administration, Fort Collins, CO (US)

( * ) Notice: Under 35 U.S.C. 154(b), the term of this patent shall be extended for 0 days.

(21) Appl. No.: 09/252,358

(22) Filed: Feb. 17, 1999

(51) Int. Cl.[7] ..... B41J 2/17
(52) U.S. Cl. ..... 347/84
(58) Field of Search ..... 347/84, 85, 29, 347/35, 49

(56) References Cited

U.S. PATENT DOCUMENTS 4,853,717 8/1989 Harmon et al. ..... 347/29
5,027,134 * 6/1991 Harmon et al. ..... 347/29
5,592,201 1/1997 Lim ..... 347/30
5,614,929 3/1997 Dangelo et al. ..... 347/30
5,999,203 * 12/1999 Cane et al. ..... 347/171
6,012,806 * 1/2000 De Olazabal ..... 347/85

* cited by examiner

*Primary Examiner*—N. Le
*Assistant Examiner*—Michael Nghiem
(74) *Attorney, Agent, or Firm*—Roth & Goldman

(57) ABSTRACT

A printhead carriage for an ink jet printer having a plurality of printhead stalls therein and a printhead holddown cover having spring biased printhead holddown plungers on the underside of the cover and equal volume fluid passageways in the cover for conducting fluid from fluid inlets on said cover exposed to atmosphere to printheads in the stalls. An arcuately moveable air pump is engageable with one of a number of arcuately positioned inlets to the passageways in the carriage cover to enable a single pump to selectively apply positive pressure to prime each of the printheads in a desired sequence.

20 Claims, 12 Drawing Sheets

APPARATUS FOR DELIVERING FLUID TO AN INK JET PRINTHEAD MOUNTED ON A MOVEABLE PRINTER CARRIAGE

CROSS REFERENCE TO RELATED APPLICATIONS, IF ANY

None.

BACKGROUND OF THE INVENTION AND PRIOR ART

The present invention relates to the art of computer driven printers, particularly, color inkjet printers. Printers of this type have a printhead carriage which is mounted for reciprocal movement on the printer in a direction orthogonal to the direction of movement of the paper or other medium on which printing is to take place through the printer. The printer carriage of a color printer typically has four or more removable thermal ink jet printheads mounted thereon. Each of the printheads contains or is attached to a supply of ink and occasionally it is necessary to prime one or more printheads by creating a pressure differential to force ink to flow through the ink delivery orifices.

Printhead priming has previously been done by positioning a compliant seal around the nozzle plate of the printhead after the printhead carriage has been parked at a service station. In these systems, ink is drawn through the printhead nozzles by applying a negative pressure to the outside of the nozzle plates of the printheads to suck ink through the orifices. The source of the negative air pressure differential has been, among others, a collapsing air bellows or a remote pump connected by a fluid conduit. In these systems, the pressure is maintained by pressing a compliant cap against the surface surrounding the nozzles to create a chamber closed to the atmosphere but connected to the pressure source. The use of negative pressure to prime a printhead can have several disadvantages such as ink foaming, excessive waste ink and lack of precise control over the priming operation. Accordingly a system for printhead priming is required which does not rely upon negative pressure priming and by which a printhead can be primed in a controlled manner with minimal risk of system damage.

SUMMARY OF THE INVENTION

In its broadest aspects, the present invention provides a printhead carriage for an ink jet printer which includes a frame having at least one printhead stall therein, the improvement comprising: a printhead holddown cover connected to said frame for fastening said cover in a closed printhead holddown position relative to the frame, said cover having at least one fluid passageway therein for conducting fluid between at least one fluid port on said cover exposed to atmosphere and a fluid port in said printhead stall, said printhead stall fluid port being engageable with a fluid port on a printhead positioned in said stall to exchange fluid with said printhead.

The present invention further provides a printer which includes the moveable carriage of the preceding paragraph and at least one inkjet printhead in operative position in a stall on said carriage and further comprising:

a) a fluid pump having a fluid outlet for delivering fluid to said inkjet printhead, said pump outlet comprising a moveable outlet proximate an end of the path of carriage travel for engagement by said carriage to actuate said pump to deliver a controlled volume of said fluid to said printhead, and b) a pump position actuator for moving said pump outlet to a selected position to connect said pump outlet to supply fluid under pressure to a selected fluid passageway in said cover and an associated printhead.

DESCRIPTION OF THE PREFERRED EMBODIMENT

Figure 1:
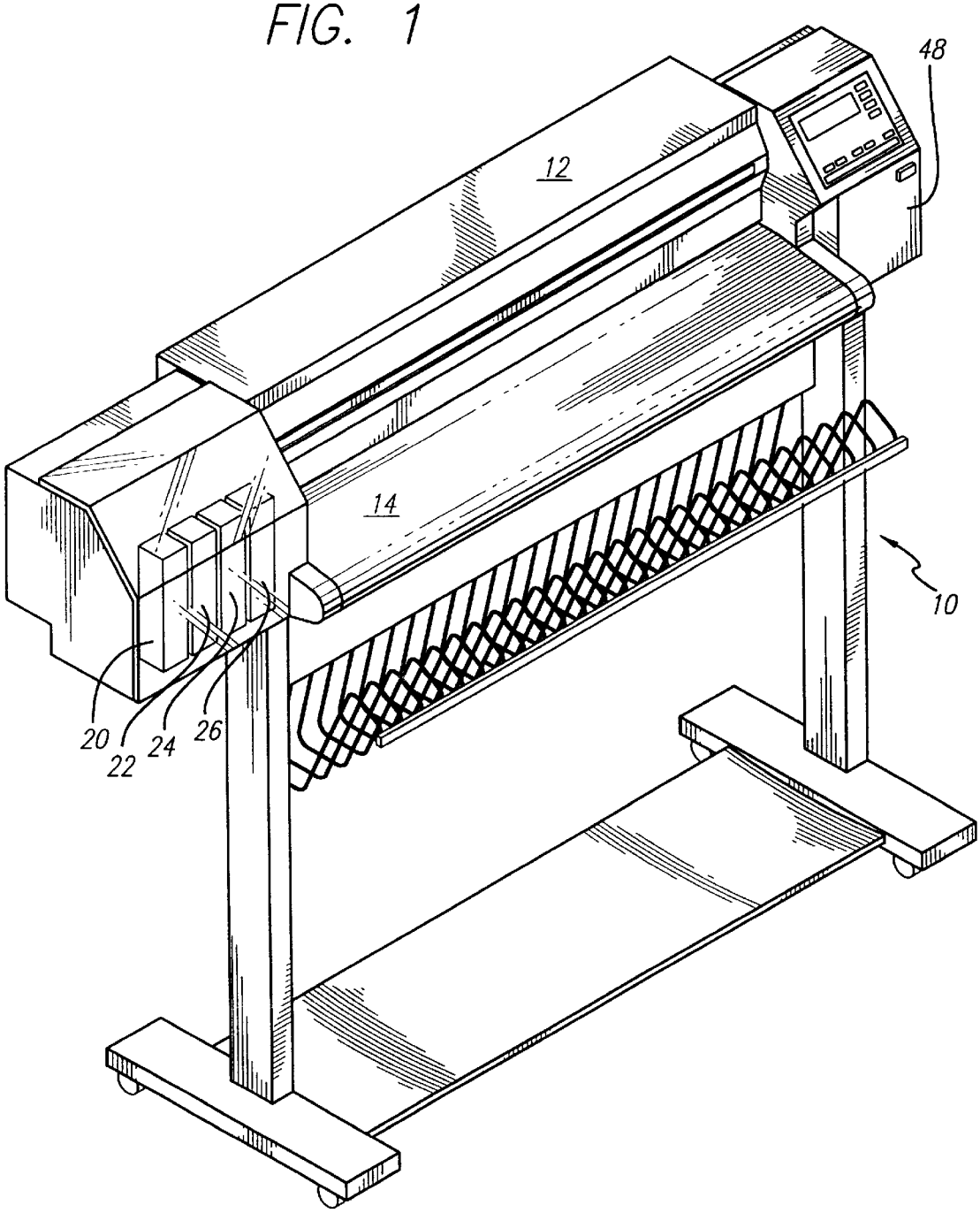
FIG. 1 is a perspective view of a large format printer in which the present invention is useful.

FIG. 1 shows a large format printer 10 of the type which includes a transversely movable printhead carriage enclosed by a cover 12 which extends over a generally horizontally extending platen 14 over which printed media is discharged into a catcher basket. At the left side of the platen are four removable ink reservoirs 20, 22, 24, 26 which, through a removable flexible tube arrangement to be described, supply ink to four inkjet printheads mounted on the moveable carriage.

Figure 2:
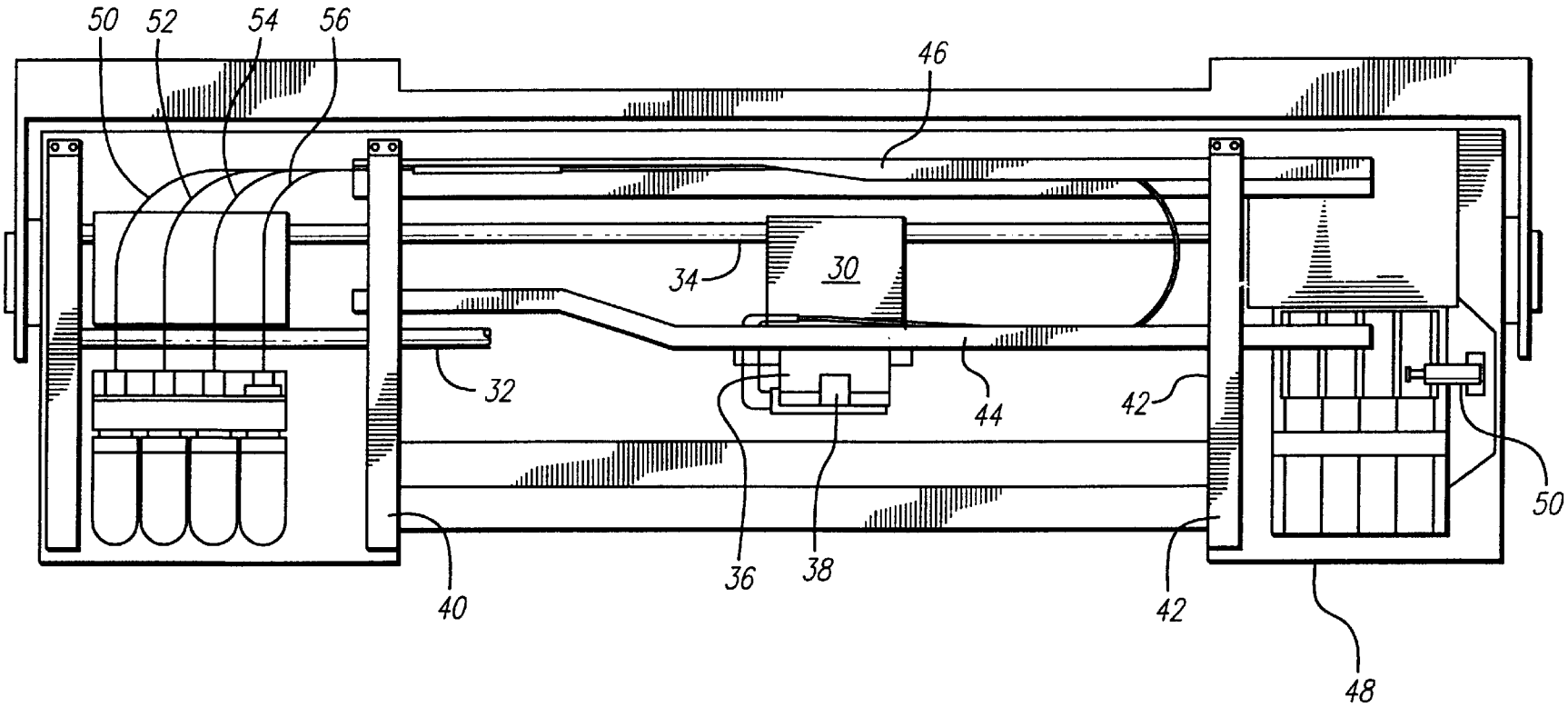
FIG. 2 is a top plan view of the printer with its cover removed to show the automatic priming pump and service station at the right end of the path of travel of the printhead carriage.
Figure 7:
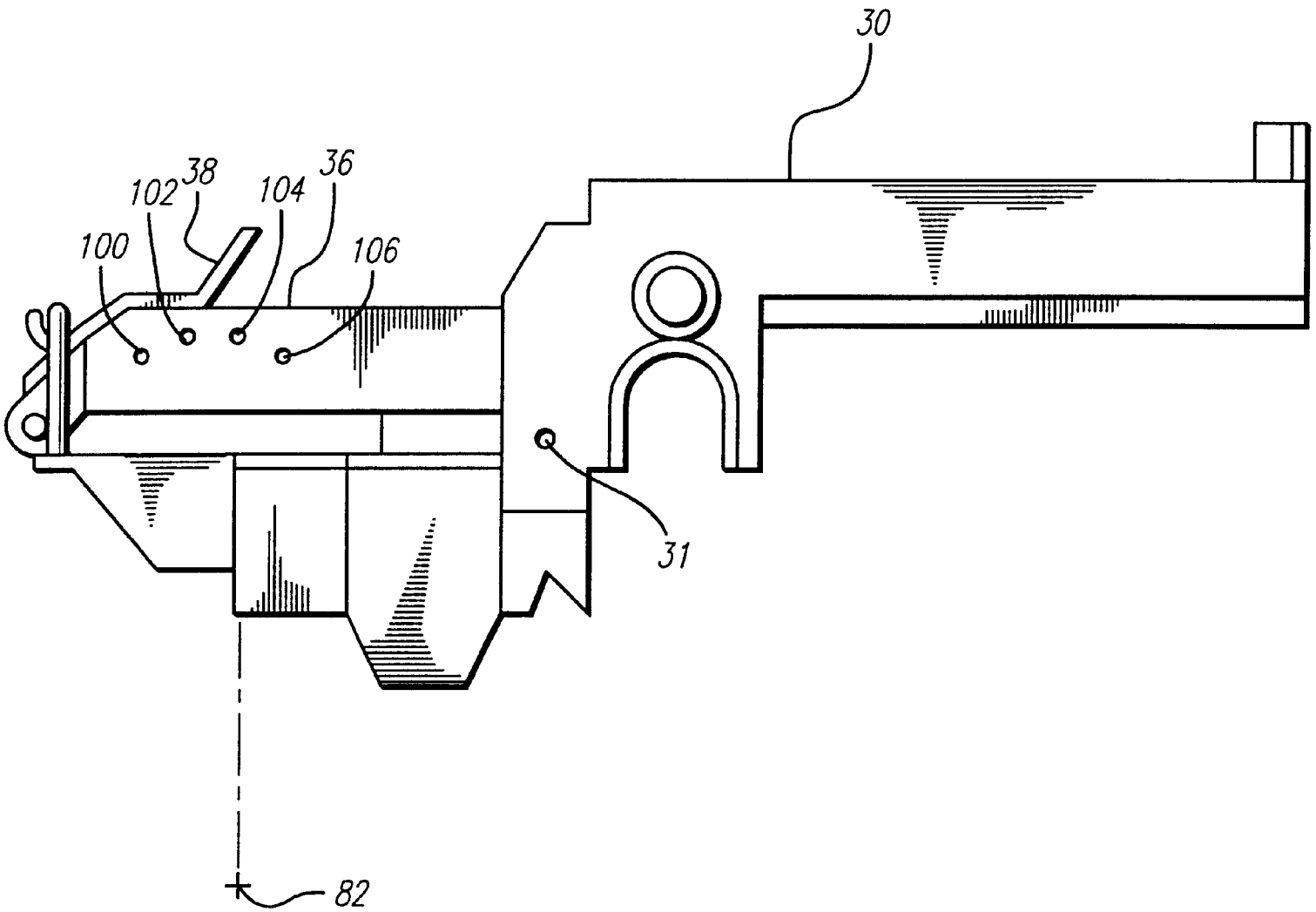
FIG. 7 is a right side elevation view of the printhead carriage with cover in the closed position.
Figure 9:
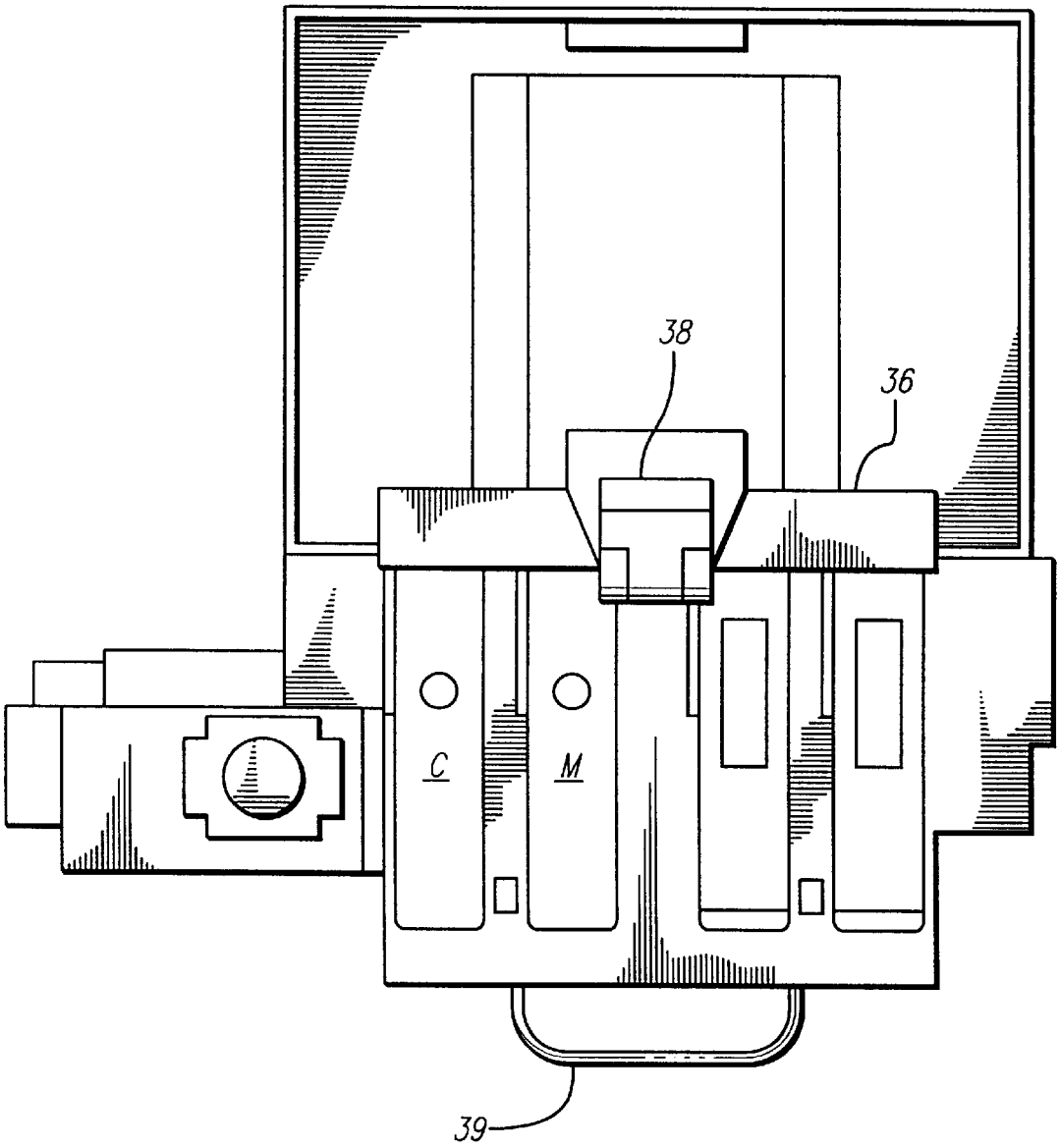
FIG. 9 is a top plan view of the carriage with printheads installed in two stalls and the cover in raised position.
Figure 10:
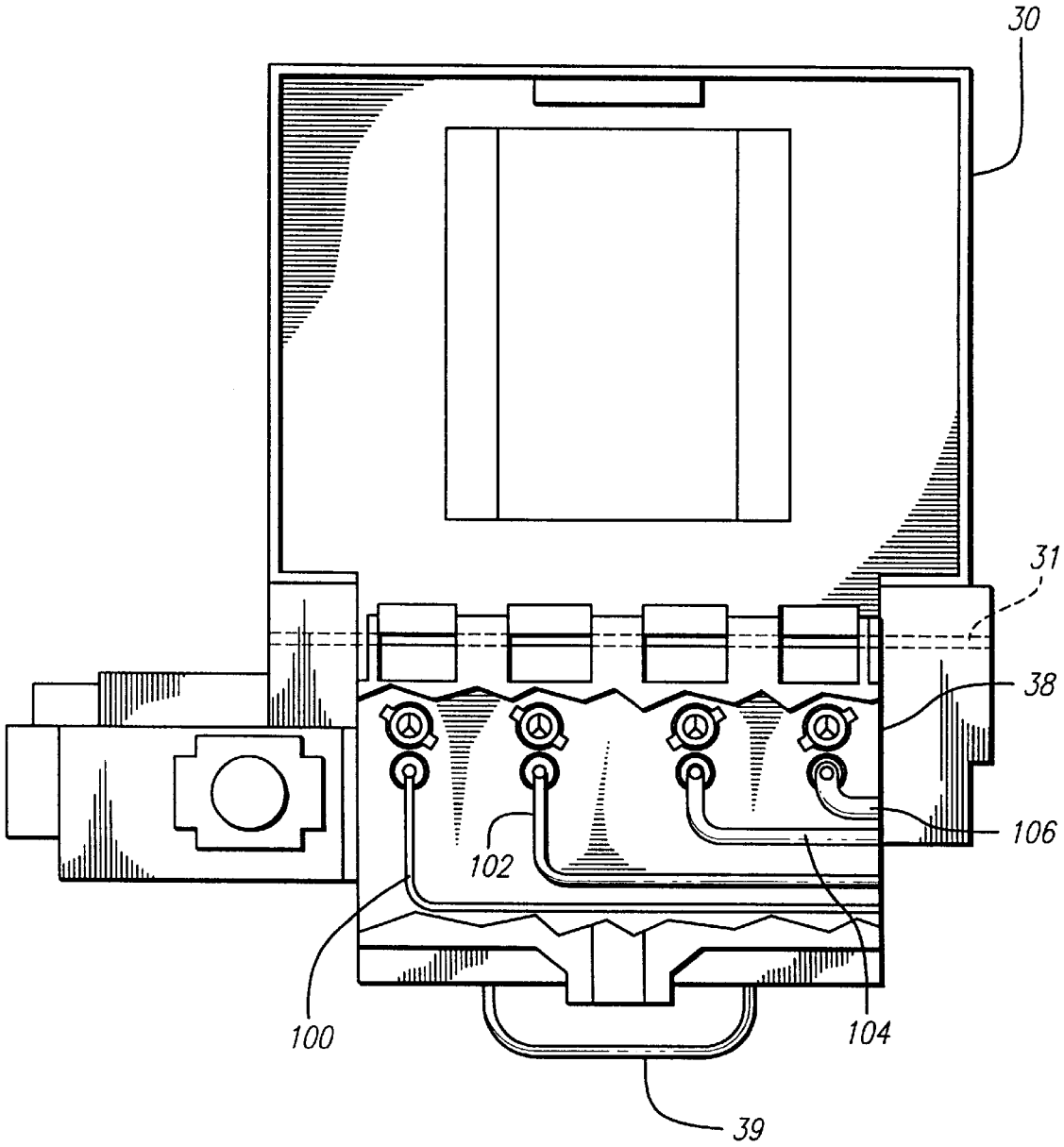
FIG. 10 is a plan view of the carriage cover partly broken away showing air passageways therein.

In the plan view of FIG. 2 in which the carriage cover 12 has been removed, it is seen that the printhead carriage 30 is mounted on a pair of transversely extending slider rods or guides 32, 34 which in turn are affixed to the frame of the printer. Also affixed to the frame of the printer are a pair of tube guide support bridges 40, 42 from which front and rear tube guides 44, 46 are suspended. The printhead carriage 30 has a pivotal printhead hold down cover 36 connected to the carriage 30 by a hinge 31 (FIG. 7) and fastened by a latch 38 at the front side of the printer which securely holds four inkjet printheads, two of which is shown in FIG. 9 in place in stalls C, M, Y, K on the carriage. The front tube guide 44 is angled near the left bridge support 40 to provide clearance for opening the printhead cover 36 when the carriage is slid to a position proximate the left side of the platen 14 so that the printhead hold down cover 36 can be easily opened for changing the printheads.

A flexible ink delivery tube system conveys ink from the four separate ink reservoirs 20, 22, 24, 26 at the left side of the printer through four flexible ink tubes 50, 52, 54, 56 which extend from the ink reservoirs through the rear and front tube guides 44, 46 to convey ink to printheads on the carriage 30. The ink tube system may be a replaceable system as described and claimed in co-pending application Ser. No. 09/240/039 filed Jan. 29, 1999 owned by the assignee of the present invention, the disclosure of which is hereby incorporated herein by reference.

Figure 8:
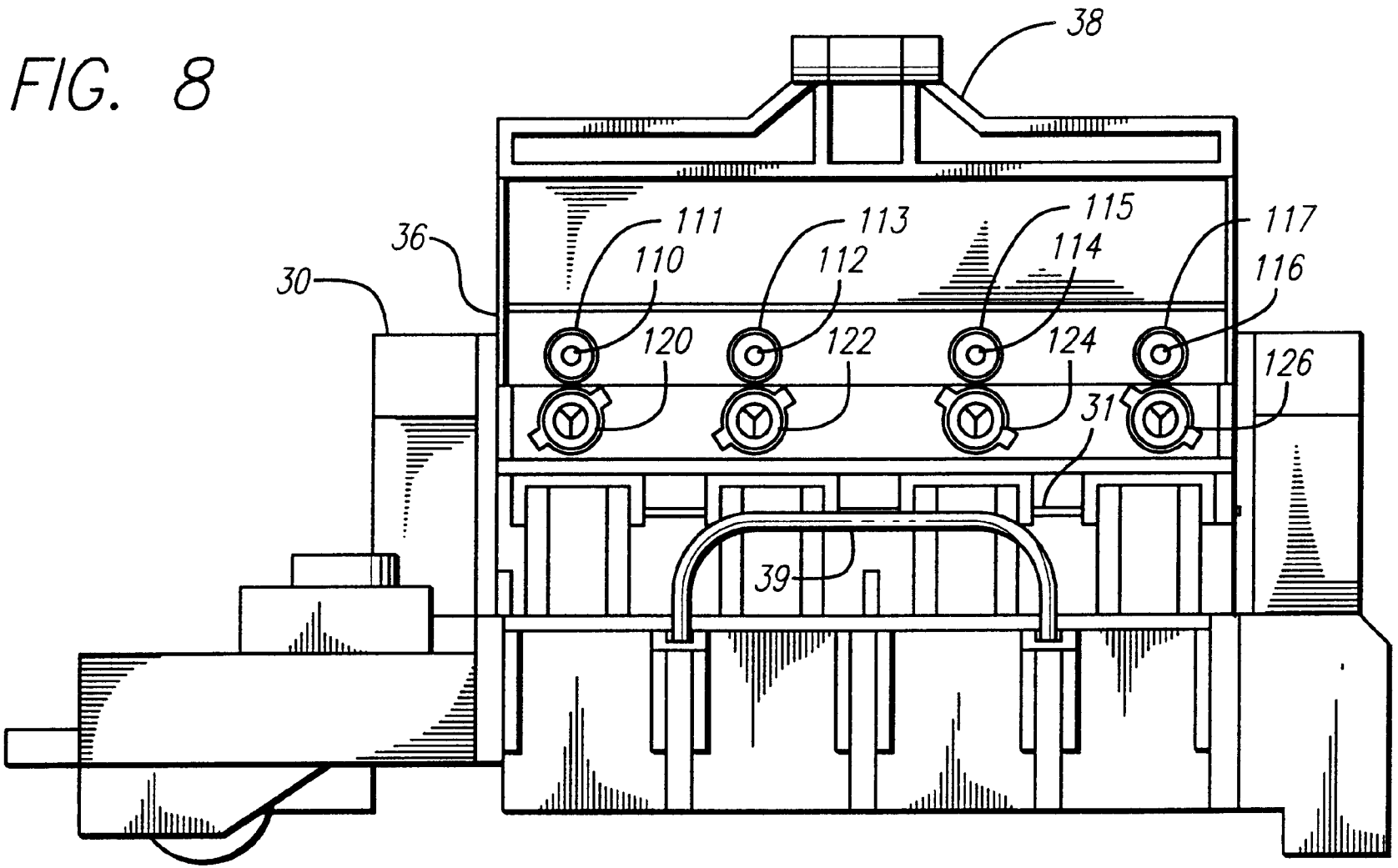
FIG. 8 is a front elevation view of the carriage showing the printhead cover in the raised position.

At the right side of the printer is a printhead service station 48 at which the printhead carriage 30 may be parked for cleaning and priming the printheads. The printhead service station 48 is comprised of a plastic frame mounted on the printer adjacent the right end of the transversely extending path of travel of the printhead carriage 30. The printhead carriage 30 (FIGS. 8 and 9) includes four stalls C, M, Y, K which respectively receive four separate printheads containing colored ink such as cyan, magenta, yellow and black. The service station 48 also includes four separate servicing stalls C, M, Y, K which may be provided on a drawer which is moveable forwardly and rearwardly of the printer. The servicing stalls each include a spittoon to capture ink discharged by the printheads during priming. The moveable drawer construction of the servicing station forms no part of the present invention.

A printhead servicing pump 50 is mounted on the upper end of a pump positioning arm 80. A gear enclosure frame 60 is affixed to the right sidewall of the frame of the service station 48 and is spaced therefrom to provide a pocket containing a speed reduction gear mechanism which positions the arm 80 and thus the pump 50 with respect to the printhead carriage 30. The positioning arm 80 is mounted for movement on a pivot axis 82 extending between the right sidewall of the service station frame and the gear enclosure frame 60. An arm positioning electric step motor 90 rotates a drive gear 92 thereon which is engaged with the teeth of a large driven gear 94 connected on a common shaft to a small driven gear 96 having teeth which mesh with an arcuate arm positioning gear 98 formed on the pump positioning arm 80 to move the arm through an angle of slightly less than 90°. Movement of the arm 80 positions the pump at various locations along an arc centered on the pivot axis 82 of the arm to align a pump outlet 520 with the inlet end of one of four air conduits 100, 102, 104, 106 arcuately positioned on the side of a pivotally mounted printhead holddown cover 36 on the printhead carriage 30.

The four air conduits each 100, 102, 104, 106 are each sized to have a substantially equal volume and extend from the inlet ends at the side of the hold down cover 36 internally of the cover and terminate in downwardly directed (when the cover is closed) fluid outlets 110, 112, 114, 116 on the underside of the printhead holddown cover. The air outlets each have a compliant seal 111, 113, 115, 117 therearound which mates with corresponding air inlet ports on the top surfaces of the four printheads when positioned in their respective stalls in the printhead carriage. Also shown on the underside of the printhead holddown cover 36 are spring loaded printhead positioners 120, 122, 124, 126. It will be seen that the printhead holddown cover is pivotally connected to the carriage and fastened in its closed or printhead holddown position by a finger latch 38 and retainer 39.

The air pump 50, which may be removably affixed to the upper end of the positioning arm 80 or permanently attached thereto as desired, comprises an open ended cylinder 510 in which an elongated piston 522 having a pair of spaced piston alignment discs 523, 524 or collars slideably engageable with the inner wall of the cylinder is received. The piston 522 is biased outwardly of the cylinder by a compression spring 525 which is seated at one end against a spring seat 526 in the pump cylinder and which is seated at its other end against a collar 57 surrounding the inner end of a hollow piston stem 58 having an elongated axial passageway 59 therethrough. A compliant seal 61 is seated against the inner piston alignment disc 54 and slideably engages the inner wall of the cylinder to provide an air seal therebetween. The walls of the seal 61 engage the cylinder 510 at an angle so that the seal 61 unidirectionally holds a positive pressure within the air chamber 68 when the piston 522 moves to the right, but does not hold a vacuum when piston 522 moves to the left. The cylinder is closed by a cover 63 attached to the outer wall of the cylinder by one or more fasteners 65, the construction of which is not relevant to the present invention. Alternatively, the cover may be threadedly affixed to the cylinder. The piston 522 has an enlarged collar 67 at its outer end on which a compliant gasket 69 is affixed for engaging the side wall of the printhead holddown cover 36 and providing an air seal between the outlet 52 of the piston and the side wall of the printhead holddown cover 36 during positioning of the carriage against the piston at the service station.

Servicing of the printheads on the printhead carriage is accomplished in part by positioning the pump 50 for alignment with the air passageway 102, 104, 106, 108 in the printhead holddown cover which conveys air to the printhead to be serviced. Movement of the carriage 30 into the service station 48 with the pump so positioned causes the carriage to engage the compliant gasket 69 at the outlet of the pump with continued movement of the carriage moving the pump piston 52 to the right into the cylinder to discharge air from the air chamber 68 in the cylinder through the central passageway 59 in the piston to thus provide a source of positive air pressure to the printhead which causes ink to be forced through the printhead orifices at the bottom of the printhead into the appropriate spittoon in the service station 48. The nozzles of the printheads C, M, Y, K may thus be primed with ink flow caused by a positive air pressure supplied by the pump 50. It will be appreciated by persons skilled in the art that the air pressure supplied by the pump need not contact the ink in the printheads and in fact should not do so to avoid introducing air which must be warehoused in the pen body. Accordingly, a printhead configuration in which ink in the printhead is contained in a chamber having a volume which can be reduced by application of air pressure to another chamber in the printhead is preferred. Travel of the printhead carriage away from the pump 50 as it leaves the service station 48 extracts the air which has been previously forced into the printhead cover. If some of the air introduced under pressure to the printhead has escaped during the process, the pump may apply an undesired amount of vacuum to the printhead. The pump design allows the pressure to be clipped at a small negative pressure of approximately −5.0 inches of water to avoid creating a vacuum before damage is done to the printhead. The seal between the pump outlet and the passageway in the printhead holddown cover is broken after the pump piston has travelled under the bias of the spring 55 to the end of its stroke. Thus any backpressure within the printhead necessary for its correct functioning should remain unaffected by the priming operation.

Figure 5:
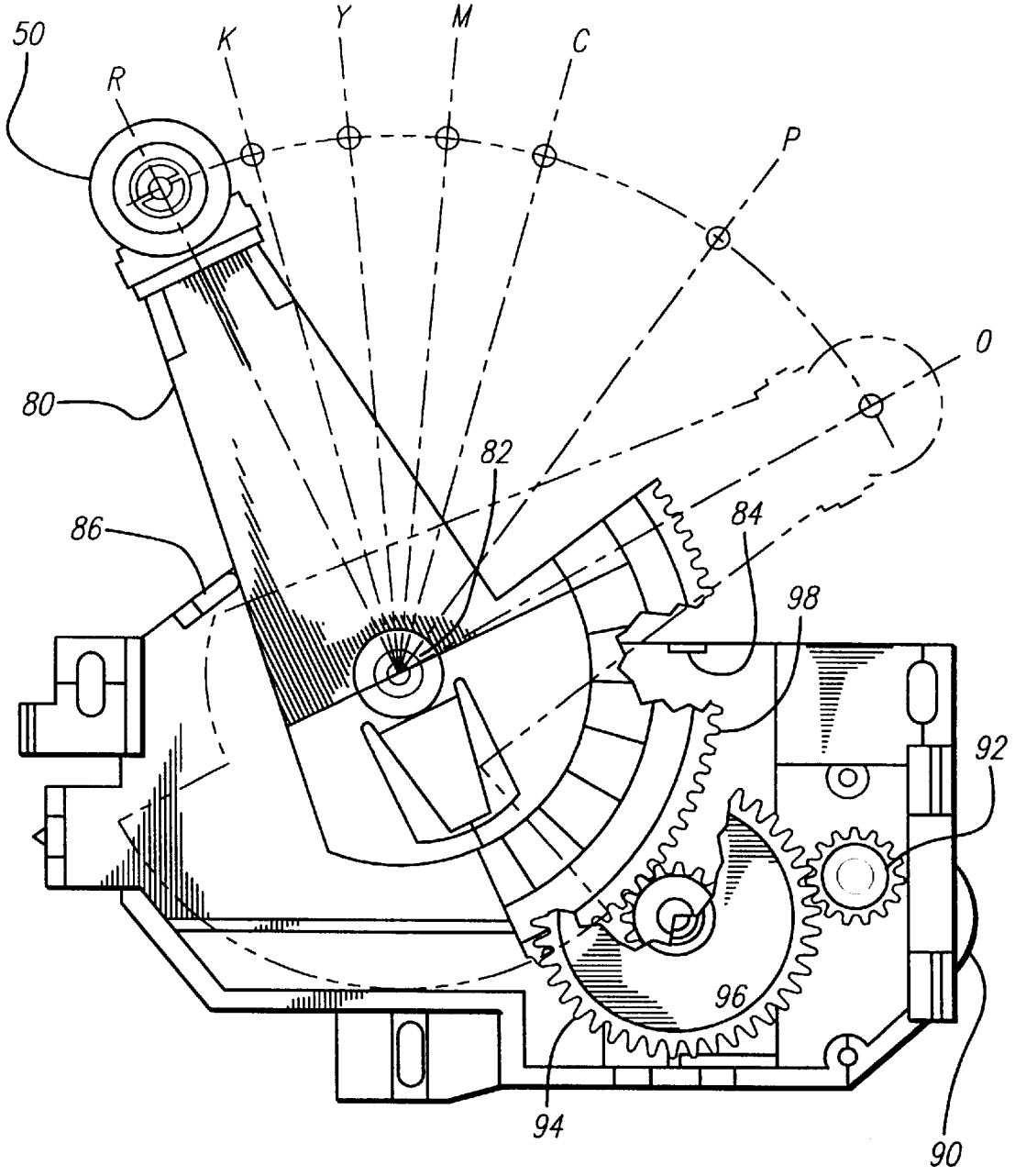
FIG. 5 is a cross-sectional elevation view taken at line 5—5 in FIG. 3, of the mechanism for moving the pump to selected positions to prime selected printheads.
Figure 6:
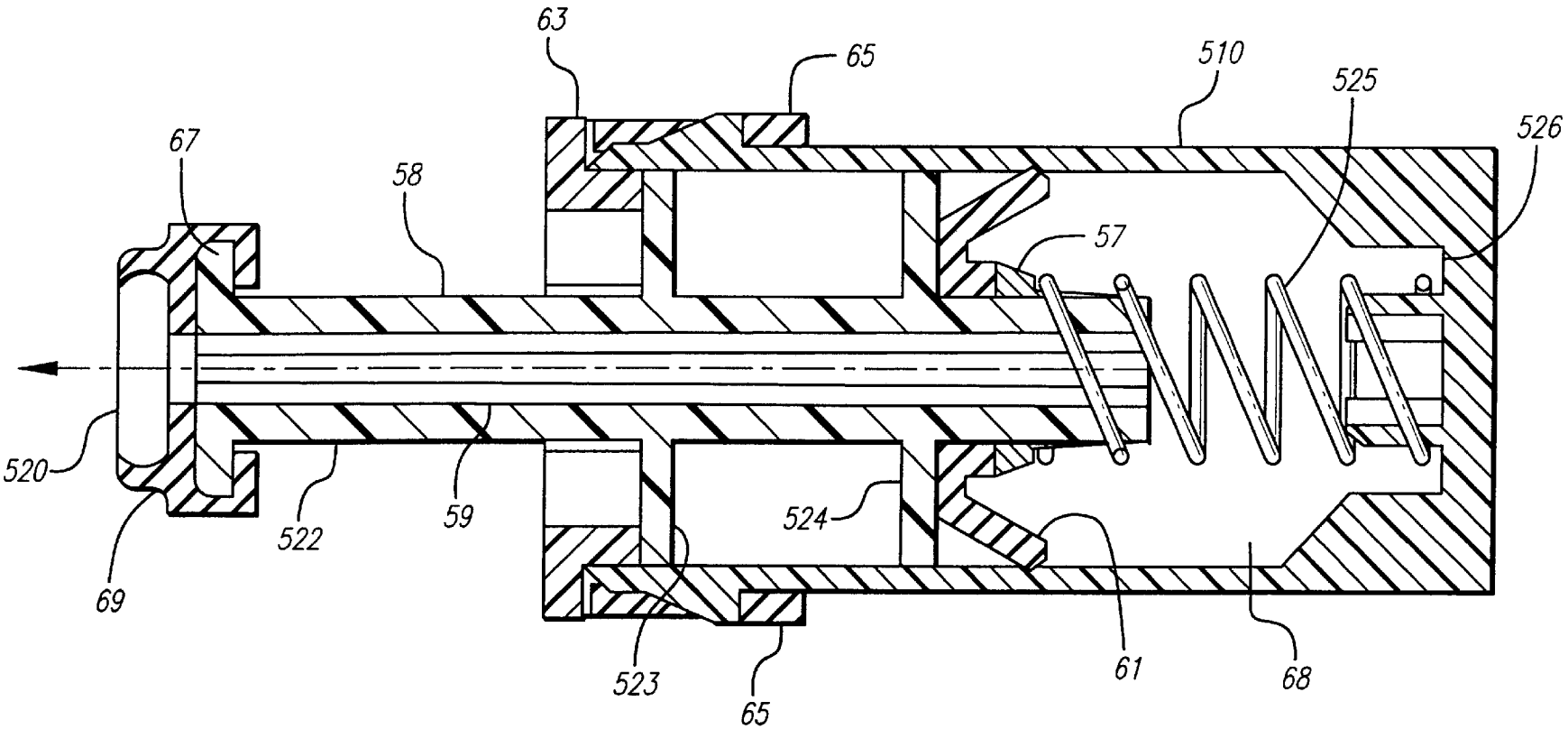
FIG. 6 is a cross-sectional elevation view through the pump.

The pump 50 is arcuately postionable as best seen in FIG. 5 anywhere between a rest position 0 and a reference position R which are defined by stops 84, 86 on the gear enclosure frame 60 which are engaged by the sides of the positioning arm 80. Positions of the arm for delivery of air by the pump to the cyan, magenta, yellow and black ink printhead conduits 100, 102, 104, 106 on the printhead carriage holddown cover 36 are shown in FIG. 5 at positions preferably spaced by approximately 6° degrees from each other.

The stepper motor 90 preferably steps the gear 92 at 3.75°/half-step and the gear train preferably provides a 30:1 reduction between the stepper motor 90 and the gear 98 on the pump positioning arm 80.

Figure 3:
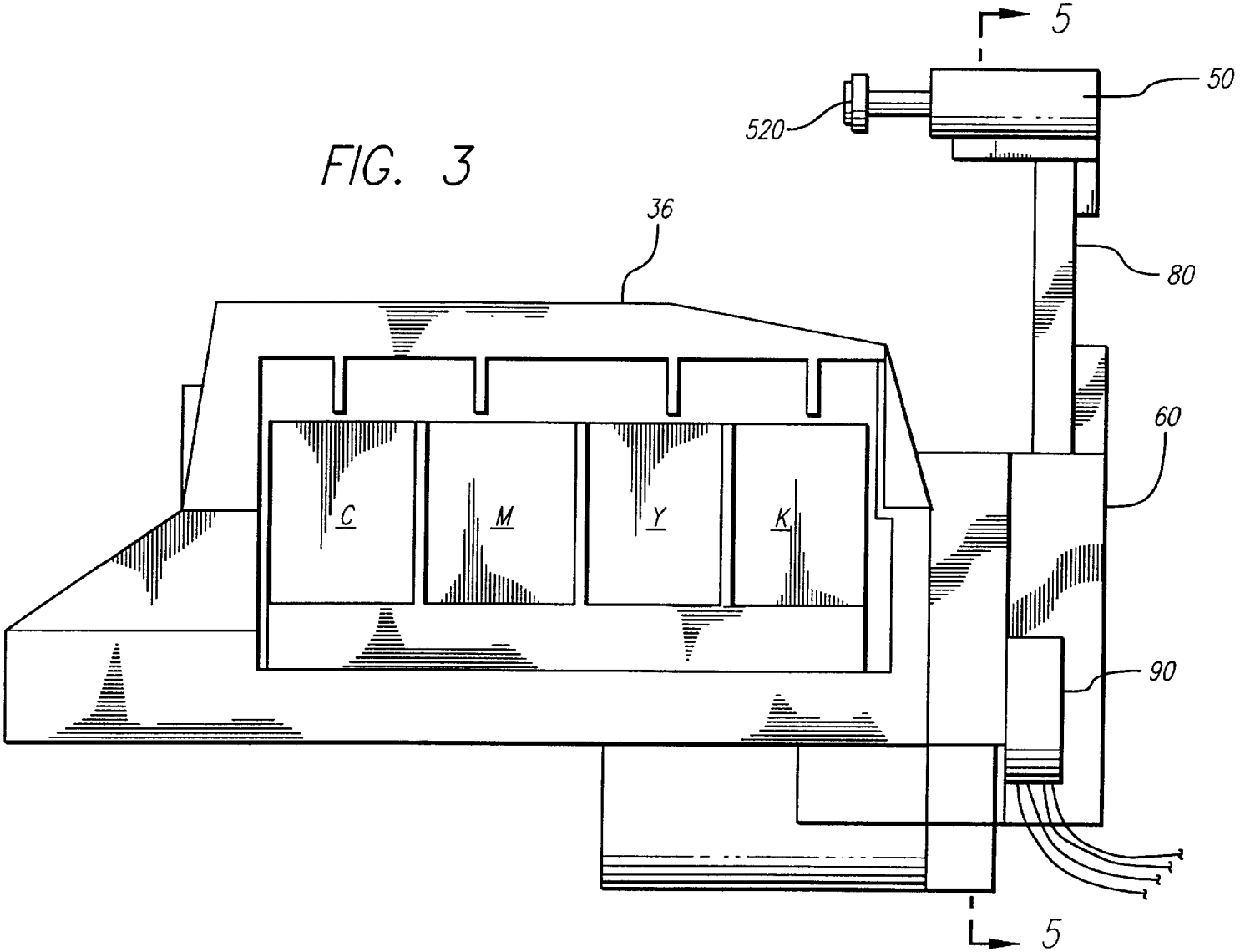
FIG. 3 is a front elevation view of the service station and priming pump.

The hard stops 84, 86 which define the limits of travel of the pump positioning arm are preferably placed at 84° from one another. For each printhead servicing cycle, the pump 50 is moved from the parking or rest position 0 in which the arm 80 engages the parking hard stop 84 to the reference position R in which the positioning arm engages the reference stop 86. The reference stop 86 is positioned closer than the parking or rest stop 84 to the functional angular positions K, Y, M, C in which the pump 50 engages the cyan, magenta, yellow and black printhead conduits 100, 102, 104, 106 on the carriage holddown cover. After movement of the pump positioning arm from the rest position 0 to the reference position R, the arm is then moved in a reverse (clockwise as seen in FIG. 3) direction to the preliminary position P. The stepper motor 90 then moves the pump positioning arm 80 in the original direction (counterclockwise in FIG. 3) to position the pump 50 in alignment with the desired functional location C, M, Y or K for connection to the related conduit 100, 102, 104, 106. This movement is performed to assure that, due to backlash, the same gear tooth face set that is used to move the pump positioning arm against the reference hard stop 86 is used to complete the accurate positioning of the pump 50 in the selected functional position.

The hard stops 84, 86 are integrally formed with the gear enclosure frame 60. This design sacrifices a small amount of positional accuracy in the nominal position of the pump 50 but decouples the hard stop function from the vertical adjustment of the gear enclosure frame 60. An over-stepping algorithm is used to ensure that the pump positioning arm 80 has contacted the reference hard stop 86. The over-stepping algorithm includes margin for both backlash and possible lost steps.

All functional angles are placed at even multiples of the nominal angular resolution. This is done to ensure that there are no pump positioning errors because an odd step total for a half-stepping algorithm is, by definition, less stable than an even step total.

Figure 4:
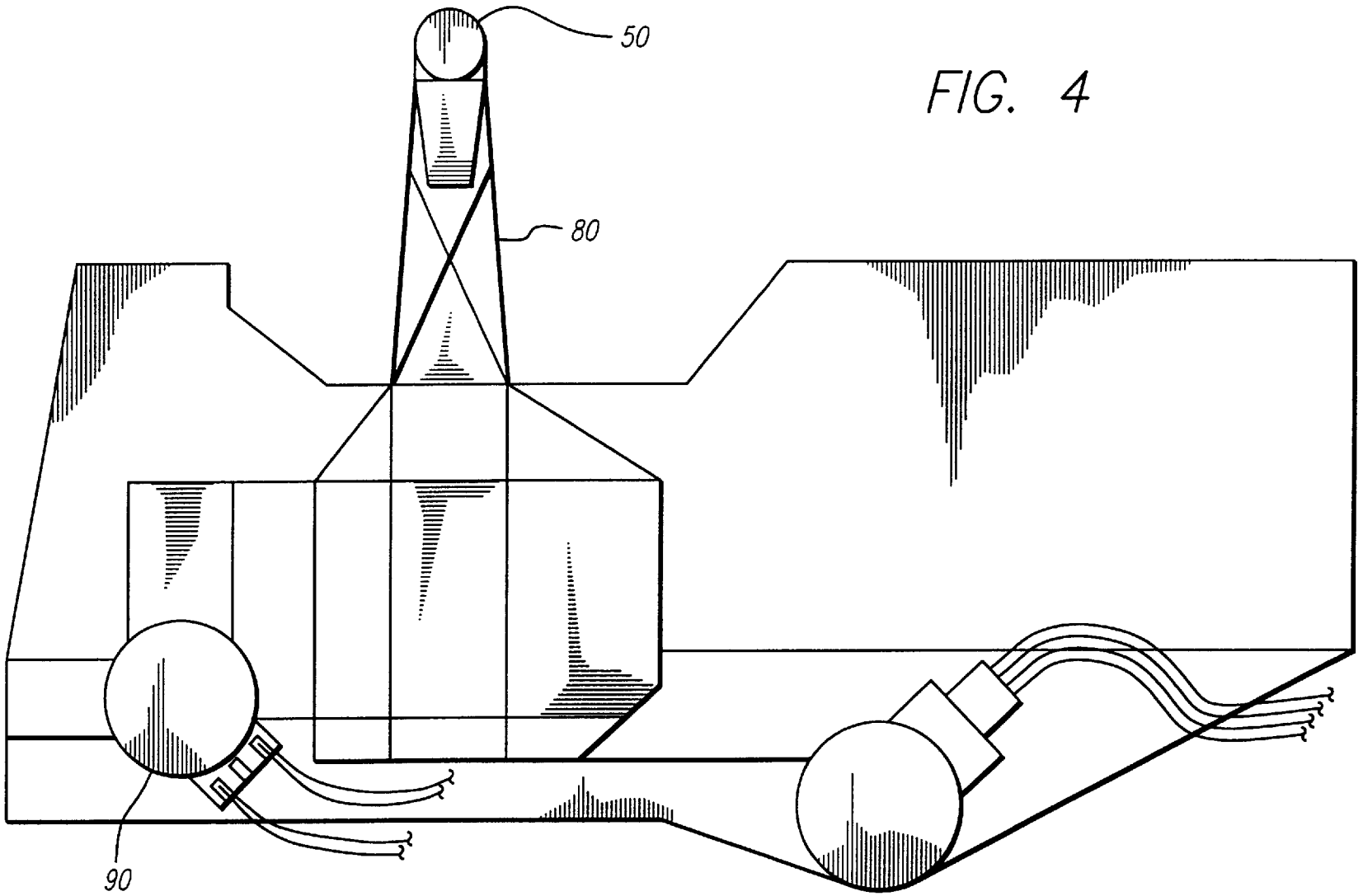
FIG. 4 is a right side elevation view of the service station and priming pump.

The inlets on the printhead holddown cover to the conduits 100, 102, 104, 106 are placed at angles of 6° from one another and are centered around a vertical line which extends through the axis 82 of rotation of the pump positioning arm 80 and are located at the same radius as the outlet of the pump 50. The axis 82 of rotation of the positioning arm 80 is placed at a maximum reasonably feasible radius from the inlets to the conduits 100, 102, 104, 106 to minimize the vertical distance (FIG. 4) between the inlets to facilitate the design of the holddown cover 36.

The radial margin around each air inlet is preferably about 2.5 mm to the inner diameter of the pump discharge gasket and 3.5 mm to the outside diameter. In the case that the vertical and horizontal alignment error of the axis of rotation 82 of the positioning arm 80 is 0, this translates to a stepping error of about 16 half-steps before the interface fails.

The stroke length or axial displacement of the pump 50 may be easily selected or adjusted to discharge a controlled volume of air to each of the printheads on the carriage. Design control of the length and cross-sectional area of each of the air passageways 100, 102, 104, 106 in the printhead holddown cover 36 to insure that the total volume of each passageway is substantially the same insures that, for a given pump stroke, the pump delivers the same volume and pressure of air to each printhead regardless of which printhead is being serviced. Each printhead priming process may be tuned individually by adjusting the pump stroke appropriately.

Figure 11:
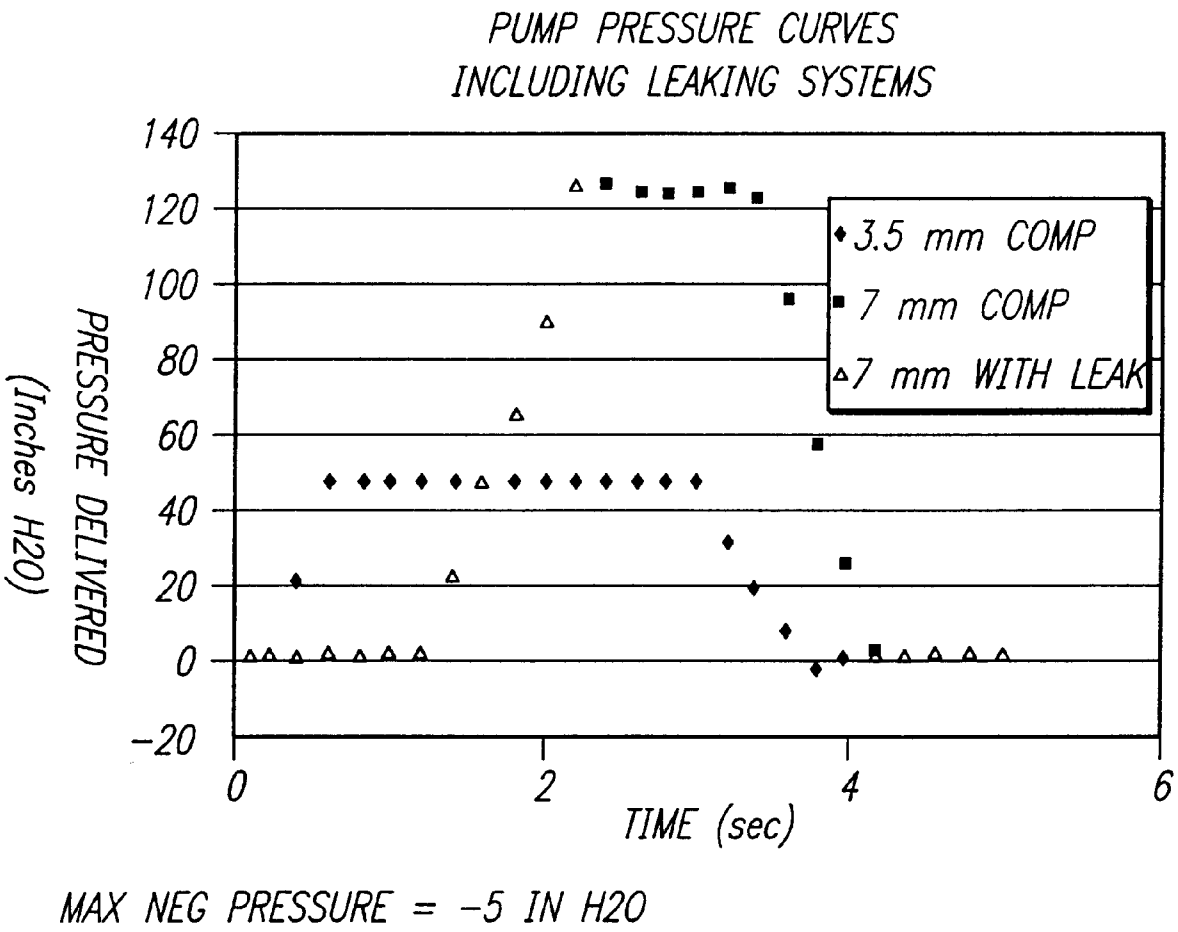
FIG. 11 is a graph plotting air pressure profiles delivered by the pump.

The pressure profile delivered by the pump is shown in FIG. 11 and is dependent upon the volume of the air passageways 102, 104, 106, 108 in the printhead holddown cover, the resting volume of the air chamber 68 in the pump itself and the rest position of the printhead carriage prior to priming. The curves shown in FIG. 11 are based upon an air passageway volume of 1.8 cc and a resting pump chamber volume of 3.2 cc. Three curves are shown. The 3.5 mm COMP curve shows the pressure profile at 3.5 mm axial displacement of the pump while the 7.0 mm COMP curve shows the pressure profile at 7.0 mm axial displacement of the pump. The third curve demonstrates the curve form when an air leak in the system is present. In this case, the priming pressure delivered to the printheads is slightly diminished but is still adequate to perform the priming function.

The precise location on the printer of the position of the compliant gasket at the pump outlet is determined by the use of a novel velocity servo bumping algorithm. The algorithm has general application to any two relatively moveable components but is more conveniently described in the context of an inkjet printer with reference to movement of the carriage 30 (a first component) with respect to the pump outlet 520 (a second component) to bump the components together preferably through a number of bumping cycles during which the current drawn by an electric motor used to move the carriage to cause the relative movement between the carriage and pump outlet is measured to establish a pulse width modification (PWM) threshold which is exceeded during the bumping. The deflection of one of the components (the pump outlet) has been characterized when the load power exceeds the threshold value.

Figure 13:
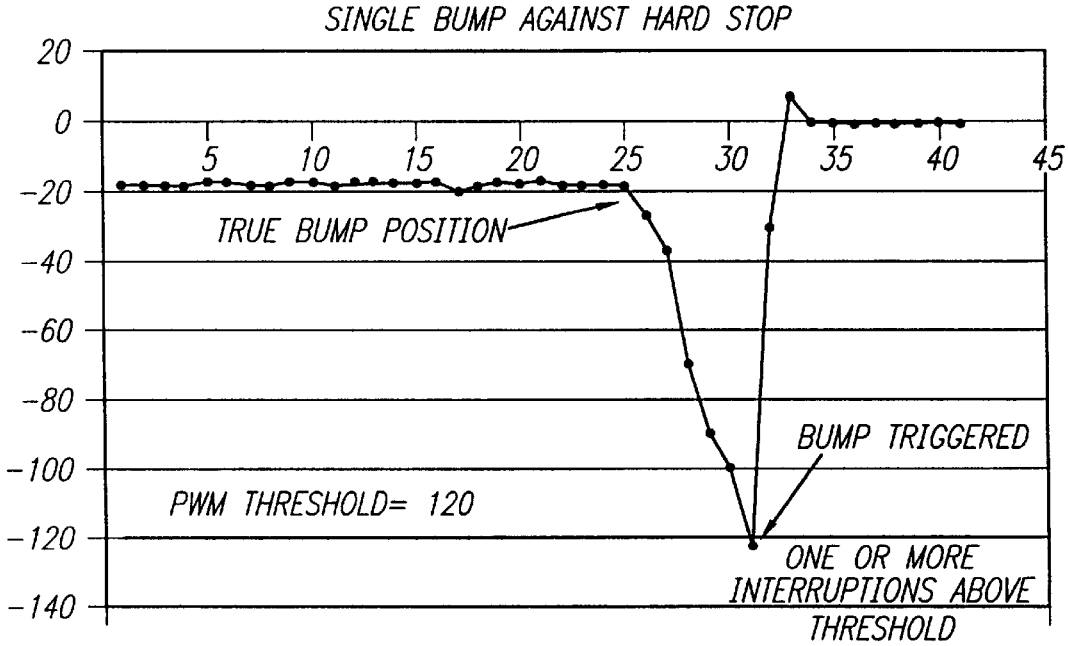
FIG. 13 is a graph of a velocity servo hard bump algorithm implementation.

Most bumping strategies require that the two contacting components have a minimum rigidity to function correctly. They typically assume that once the parts contact there will be no deformation or at least that the resulting deformation will be less than the precision required by the system. These algorithms, therefore, cannot be applied to systems having flexible components such as the compliant gasket 69 at the pump outlet 520. FIG. 13 shows a plot of carriage drive motor load pulse width modification (PWM) against interruptions in milliseconds along the horizontal axis for printhead carriage measurements for a hard bump environment.

To recognize the contact of a flexible component, the algorithm must react to single impulses in the PWM profile. This is to say that the servo algorithm must respond if the threshold is exceeded for a single processor interruption (1/1000 sec.). Also, the servo parameters must have a very undamped response to velocity error. The algorithm depends on the PWM instability at the point of contact to recognize the flexible component. Because the impact can be somewhat unstable and because there is additional noise in the system due to other sources, several bumping samples must be taken to insure data consistency. This data must pass the following sanity checks to be considered valid:

1. The average reading must not exceed a maximum variation from the nominal value (taken as 4σ of the distribution across many previous printers);
2. The 3σ value of the measurement distribution must not exceed a critical value for mechanism function (reading Cp); and
3. No single reading can vary from each machine's own distribution average by more than a critical value (erroneous data point).

Because of the delay of the servo and the compressibility of the flexible components, an offset should be calculated when determining the bump position. As seen in the PWM evolution shown in FIG. 12 where the horizontal axis indicates interruptions in milliseconds, time B indicates when the PWM threshold (−28 as shown) was exceeded and time A indicates the point at which the true first contact occurred. The positional offset due to these effects has been characterized and shown to be repeatable. This occurs particularly in the case in which two flexible components are assembled in series (the gasket and the spring) with one of the two having a much higher stiffness and particularly preload.

Figure 12:
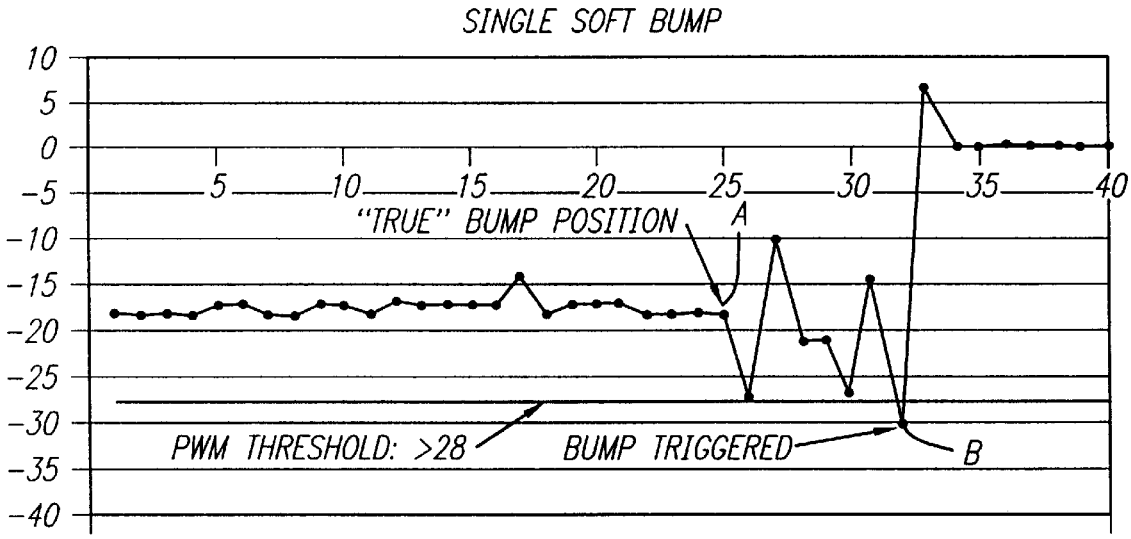
FIG. 12 is a graph of a velocity servo soft bump algorithm implementation.

FIG. 12 also demonstrates the transient noise which occurs due to both inertial and friction/stiction effects while accelerating the carriage and approaching the pump. To reduce the risk that the PWM threshold will be exceeded during this phase, carriage movement is started sufficiently far from the nominal position to ensure that discarding the first half of the PWM profile will both eliminate this noise and ensure the flexible component (the pump) is not touched during the initial movement.

The carriage is repeatedly positioned to deflect the pump outlet and during the bumping procedure. The currently preferred algorithm includes the following:

1. Number of bumping cycles: 12.
2. Offset due to connect gasket compression: 6 encoder units (0.25 mm).
3. Maximum variation of average reading from nominal: 24 encoder units (1.0 mm).
4. Maximum 3σ value: 12 encoder units.
5. Maximum single point deviation from average: 6 encoder units.

It has been found that the position of the pump outlet can vary by up to 1.0 mm during construction of a printer. Use of the above positioning algorithm reduces the error between actual pump outlet position and optimum pump outlet position to a maximum of 0.25 of this amount.

It will be appreciated by those skilled in the art that, while the specific embodiment of the present invention described utilizes a carriage actuated pump to deliver air under pressure to a printhead, the invention also extends to the use of a carriage actuated pump to generate a vacuum within a printhead and to deliver a liquid, such as ink, to a printhead.

Persons skilled in the art will understand that the above disclosure of the preferred embodiment of the invention may be modified and that the scope of the invention is defined in its broadest sense only by the following claims.

What is claimed is:

1. A printhead carriage for an ink jet printer comprising a frame having at least one printhead stall therein, a printhead holddown cover connected to said frame and means for fastening said cover in a closed printhead holddown position relative to the frame, said cover having at least one fluid passageway therein for conducting fluid between at least one fluid port on said cover exposed to atmosphere and a fluid port in said printhead stall, said printhead stall fluid port being engageable with a fluid port on a printhead positioned in said stall to exchange fluid with said printhead.

2. The printhead carriage of claim 1, wherein said port exposed to atmosphere is on an upwardly extending side surface of said cover.

3. The printhead carriage of claim 2, wherein said cover has a plurality of said passageways, said passageways each extending between a port exposed to atmosphere and a port in a printhead stall, said ports exposed to atmosphere being arranged on an arc.

4. The printhead carriage of claim 3, wherein said arc is centered on a line extending below and parallel to a printhead scan axis.

5. The printhead carriage of claim 3, wherein said fluid passageways are of substantially equal volume.

6. The printhead carriage of claim 5, further comprising compliant fluid seals surrounding said ports in said printhead stalls.

7. The printhead carriage of claim 6, wherein said means for fastening includes a hinge connecting said cover to said frame.

8. The printhead carriage of claim 7, wherein said means for fastening further includes a latch for fastening said cover to said frame.

9. The printhead carriage of claim 8, wherein said cover further includes a spring loaded plunger on an underside of the cover in each printhead stall for urging printheads into operative positions in said stalls.

10. The printhead carriage of claim 9, wherein said spring loaded plungers are between said hinge and said compliant seals.

11. The printhead carriage of claim 10, wherein said spring loaded plungers are proximate said hinge.

12. A printer which includes the moveable carriage of claim 1 and at least one inkjet printhead in operative position in a stall on said carriage and further comprising:

a) a fluid pump having a fluid outlet for delivering fluid to said inkjet printhead, said pump outlet comprising a moveable outlet proximate an end of the path of carriage travel for engagement by said carriage to actuate said pump to deliver a controlled volume of said fluid to said printhead, and b) a pump position actuator for moving said pump outlet to a selected position to connect said pump outlet to supply fluid under pressure to a selected fluid passageway in said cover and an associated printhead.

13. The printer of claim 12, wherein said actuator comprises an arm pivotally mounted on said printer for movement in an arcuate path about a pivot axis which extends parallel to the direction of carriage movement and said pump is mounted on said arm.

14. The printer of claim 13, further comprising a motor and a gear train connecting said motor to said arm for moving said arm to move said pump in said arcuate path.

15. The printer of claim 14, wherein said means for fastening comprises a hinge and a latch for fastening said cover to said carriage.

16. The printer of claim 15, wherein said cover further includes a spring loaded plunger on an underside of the cover in each printhead stall for urging printheads into operative positions in said stalls.

17. The printer of claim 16, wherein said passageways each have a compliant seal on the underside of said printhead cover, said seals engaging fluid inlets on said printheads when said cover is closed.

18. The printer of claim 17, wherein said pump comprises: a housing defining a pump chamber therein, a pump piston in said chamber, said piston having a stem with a fluid discharge conduit extending through said stem to terminate at said pump outlet, a spring biasing said piston to maximize the volume of said pump chamber, and a seal at said pump outlet for engagement with a fluid delivery conduit on said printer carriage in fluid communication with said printhead.

19. The printer of claim 18, wherein said pump outlet is positioned to be axially moved by engagement with a side of said carriage to compress said spring to expel fluid from said stem.

20. The printer of claim 19, wherein said fluid is air.

* * * * *